United States Patent [19]

Dodge, Jr. et al.

[11] Patent Number: 4,595,174

[45] Date of Patent: Jun. 17, 1986

[54] HORIZONTAL LINE GRIP DEVICE

[75] Inventors: Cleveland E. Dodge, Jr., Pownal, Vt.; Lawrence R. Stafford, Albany, N.Y.

[73] Assignee: International Dodge, Inc., New York, N.Y.

[21] Appl. No.: 745,378

[22] Filed: Jun. 17, 1985

Related U.S. Application Data

[63] Continuation of Ser. No. 544,602, Oct. 24, 1983, abandoned.

[51] Int. Cl.[4] ..... H47L 3/04; A62B 35/00; B65H 59/16; E06C 7/18

[52] U.S. Cl. ..... 254/391; 24/134 R; 182/4; 182/71; 188/65.1; 254/402

[58] Field of Search ..... 254/391, 397, 401, 402, 254/403, 404, 405, 408, 411, 412, 416, 417; 188/65.1, 65.2; 182/4, 5, 71, 192; 24/132 R, 132 AA, 132 WL, 134 R, 134 KA, 134 KB, 134 L, 134 N, 134 P

[56] References Cited

U.S. PATENT DOCUMENTS

| | | | |
|---|---|---|---|
| 544,724 | 8/1895 | Cotton et al. | 182/71 X |
| 1,260,583 | 3/1918 | Schwartz | 24/134 R |
| 1,576,210 | 3/1926 | Nickson | 24/134 KB |
| 1,926,975 | 9/1933 | Endsor | 24/134 R |
| 2,200,896 | 5/1940 | Rio | 188/65.1 |
| 2,608,174 | 8/1952 | Sponenburg | 254/391 X |
| 3,198,290 | 8/1965 | Maio | 188/65.1 |
| 3,389,765 | 6/1968 | Pressley | 182/5 X |
| 3,470,982 | 10/1969 | Warden | 188/65.2 X |
| 3,876,036 | 4/1975 | Sweet | 188/65.2 X |
| 4,140,207 | 2/1979 | Sharp et al. | 188/65.1 |
| 4,225,012 | 9/1980 | Hindle | 188/65.2 X |
| 4,253,218 | 3/1981 | Gibbs | 188/65.1 X |

FOREIGN PATENT DOCUMENTS

| | | | |
|---|---|---|---|
| 18581 | of 1905 | United Kingdom | 182/5 |
| 649919 | 2/1951 | United Kingdom | 24/134 |
| 1077068 | 7/1967 | United Kingdom . | |

*Primary Examiner*—Stuart S. Levy
*Assistant Examiner*—Joseph J. Hail, III
*Attorney, Agent, or Firm*—Handal & Morofsky

[57] ABSTRACT

A grip device for mounting along a horizontal line, such as a rope or cable, to prevent a load from falling when one end of the line is no longer supported in its horizontal position. The device consists of a shell in which is mounted by means of a pin, a clamping wedge arranged such that when the handle of the wedge is moved in either direction, the wedge becomes clamped against the rope or cable to prevent movement of the rope through the device, and therefore prevent falling of a person attached to the device by means of an approved belt, harness or lanyard.

13 Claims, 2 Drawing Figures

HORIZONTAL LINE GRIP DEVICE

This application is a continuation of application Ser. No. 544,602, filed 10/24/83, now abandoned.

TECHNICAL FIELD

This invention relates generally to grip devices mountable on a horizontal line to support a load. More particularly, it relates to a new grip device which will effectively grip the line when a load is placed thereon to thus provide support for said load when moved in either direction.

BACKGROUND ART

A number of line grip devices have been invented and patented which are designed to travel up and down a vertical safety line and clamp onto the line so as to prevent the object from falling when pressure is exerted on the handle of the device. Dodge Machine Co., Inc. currently offers a rope grip for a vertical line with a number of desirable qualities, for example the rope grip is manufactured from large simple pieces of material which distribute the impact of a fall through relatively massive pieces of metal providing for strength, reliability, and safety. It can be attached to a person by means of a lanyard so that it can be moved up and down the rope without the person having to place his hand on the grip which makes it convenient to use. This rope grip can be placed over a rope anywhere along the length of a rope, providing additional convenience. The Dodge rope grip is versatile as it can be used with ropes having a variation in diameter of as much as a quarter of an inch. A patent application for this device is now pending, entitled "Removable Double Action Rope Grip", U.S. Ser. No. 501,623 now U.S. Pat. No. 4,502,668.

Another such device is the Barrow-Hepburn Everest Rope Grip patented in the U.K. as Pat. No. 1,077,068. This rope grip operates by means of three steel balls in a conical housing. The rope is passed through the steel balls so that when the grip begins to fall rapidly down the rope the steel balls are drawn into the conical housing, jamming the rope. This rope grip thus provides a degree of fail safe operation in vertical line grips.

The prior art has serious shortcomings with respect to providing effective means for protecting a worker who depends upon a horizontal safety line. In many ways a horizontal safety line provides optimal protection for a worker on a scaffold. This is so because a scaffold worker needs adequate freedom of movement particularly in a horizontal direction. In order to have the necessary freedom of movement, there would have to be a considerable amount of slack in any type of vertical safety line. Accordingly, in the event of a failure of a support line of the scaffolding a worker would fall a considerable distance before a vertical safety line would take effect; whatever gripping device was used.

If one of the supporting lines of the scaffold fails, thus suddenly causing that end of the scaffold to fall downward, a worker should be protected by a horizontal line. Such a horizontal line could be mounted on the scaffold. A horizontal line gripping device suitable for use on this type of horizontal line must be able to clamp onto the line as a result of rapid movement in either direction. The prior art does not meet this need.

Because of the law of gravity discovered by Newton, that objects having different weights will all fall at the same rate of speed, it is advantageous for a line grip device to employ means which will actuate the device when upward pressure is removed. Prior inventions describe a great number of different types of springs arrangements which can be used to activate line grip devices when upward pressure is removed. In the case of a line grip device operating on a horizontal line, it is not practical to have the device operated by means of a spring which is counteracting the gravitational weight of the device. The present invention solves this problem by using the spring action of the line on which the device is mounted to actuate the device. In this way the device will actuate in two directions rather than in one as is the case with a multiplicity of vertical devices.

DISCLOSURE OF INVENTION

The invention as claimed is intended to provide a solution to the problem of providing a line grip device which will securely grip the line as a result of rapid movement in either direction.

The same is accomplished in the embodiment of the invention illustrated below by providing a line grip device with a U-shaped shell through which the safety line travels at the bottom of the U. The device is configured and dimensioned so as to cause the line to make a turn as it passes through the device between the bottom of the U-shaped shell and the face of a cam arm which is pivotally engaged within the shell. As the safety line is pushed into an arc by the device, the line itself acts as a spring against the cam arm. The line creates a force against the cam arm, urging it into locking position. The cam arm will lock into position in either direction when a pulling force is placed on it due to the spring action of the line and the symmetrical construction of the device.

In order that the device can be moved along the line, it is only necessary for the operator to hold the cam arm in a position at right angles to the wire rope and move the device along the line against a slight force exerted by the bending the rope into an arc between the pin and the cam arm.

The device as illustrated below can be easily installed on a wire rope or removed from it by merely withdrawing the pivot pin which allows the cam arm and shell to be separated.

BRIEF DESCRIPTION OF DRAWINGS

One way of carrying out the invention is described in detail below with reference to the drawings which illustrate only one specific embodiment of the invention in which.

BEST MODE FOR CARRYING OUT THE INVENTION

Figure 1:
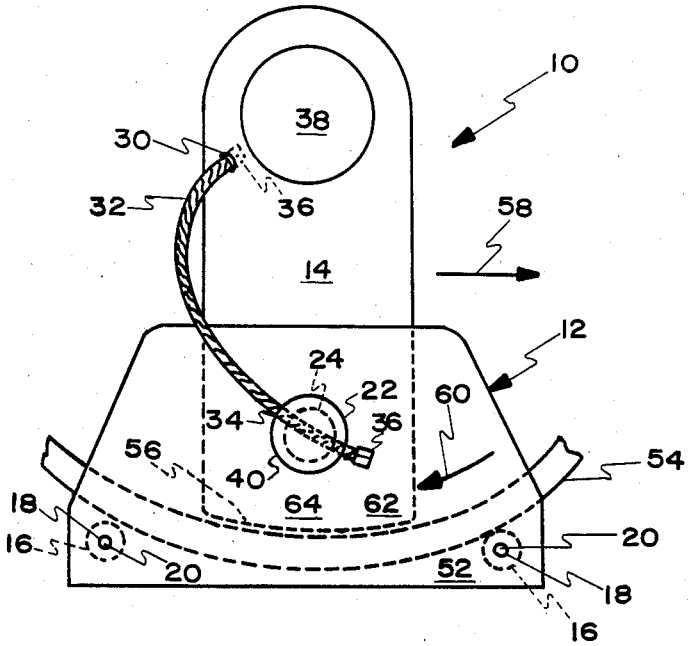
FIG. 1 is a top plan view of the inventive grip.

The figures show a line grip device 10 constructed in accordance with the present invention. Referring to FIG. 1, inventive grip device 10 comprises generally a shell 12, a cam 14, and a pair of cylindrical rollers 16. Shell 12 has four holes 18 through which rivet pins 20 pass in order to rotably support rollers 16 in the interior of shell 12. Rollers 16 are preferably made of hardened steel so as to be extremely wear-resistant.

Shell 12 also has two holes 22 through which mounting rod 24 may pass. As can be seen more clearly in FIG. 2, cam 14 also has a hole 28 through which mounting rod 24 passes in order to rotably support cam 14.

Cam 14 has an additional hole 30 through which a retaining cable 32 is shown in FIG. 1 passes. Cable 32 also passes through a hole 34 in mounting rod 24 and is secured at either end by two wire clamps 36, which are larger than holes 30 and 34, thus securing cam 14 to mounting rod 24. Retaining cable 32 minimizes the risk of loss of mounting rod 24, since in the event the device is disassembled and mounting rod 24 is removed, the mounting rod remains secured to cam 14. Cam 14 has a large hole 38 which can serve as a means to secure device 10 to a user by way of a lanyard or ther suitable device.

Figure 2:
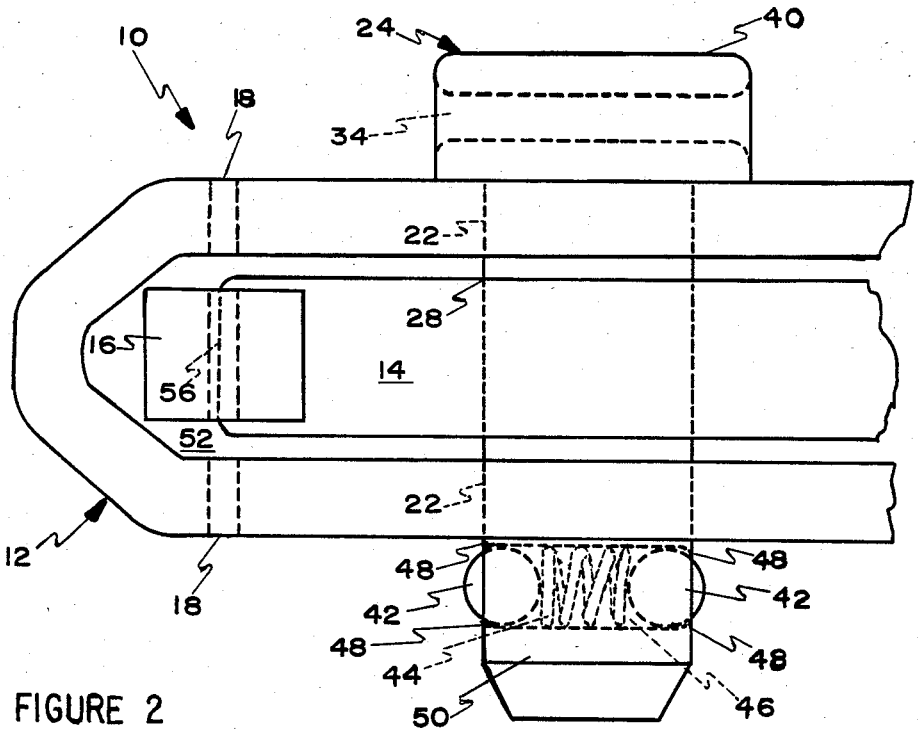
FIG. 2 is an enlarged partial side plan view of details of the grip shown in FIG. 1.

Shell 12 is formed from a single piece of steel formed into a U-shape, as seen most clearly in FIG. 2.

Mounting rod 24 has a large head 40 and pair of retaining balls 42 disposed about either side of a spring 44. The mounting rod as illustrated, might commonly be called a detent pin. The axial travel of mounting rod 24 through the holes 22 is limited in one direction by large head 40 and in the other direction by retaining balls 42. Mounting rod 24 has a channel 46 which is generally larger in diameter than retaining balls 42, however channel 46 has lips 48 which restrict the channel to a size smaller in diameter than balls 42, preventing balls 42 from escaping channel 46. Spring 44 is positioned so as to force the retaining balls to the outer portion of channel 46 so that their radii extend beyond the walls of the mounting rod, preventing the mounting rod from passing through holes 22.

The mounting rod is threaded, as is the end 50 of the mounting rod so that end 50 may be removed and replaced as desired. End 50 comprises part of the channel 46 so that when end 50 is removed, retaining balls 42 and 44 may be removed and the mounting rod may be withdrawn and the device disassembled.

With the mounting rod no longer holding the cam in position, the cam may be removed and an interior 52 of device 10 no longer defines a closed polygonal section. Thus U-shaped shell 12 may be placed over a safety line and the device re-assembled as desired. Accordingly, it is thus not necessary to thread a safety line through the device in every case.

The inventive line grip device constructed as noted above has the advantages of not requiring the rope to be threaded through the device, as well as convenient disassembly for cleaning, due to the removable nature of mounting rod 24.

Of course there are a multitude of possible configurations that might be used for constructing a mounting pin, which may or may not be removable. For instance, a simple rivet, or a locking type device might be used in lieu of mounting rod 24 illustrated above. It should be noted however, that any permanent type of mounting pin will not offer all of the advantages detailed above with removable mounting rod 24.

When assembled about a line 54 (line 54 is preferably made up of wire of stiff filament), cam 14 is rotably mounted about mounting rod 24. An inner surface 56 of cam 14, together with shell 12 defines a channel whereby the device is secured about the line as shown in FIG. 1.

Rollers 16, operating in conjunction with cam 26 utilize the rigid properties of line 54 to advantage. In short, the device uses the spring like nature of the line to provide fail safe operation to give added protection to the user of the device.

As device 10 moves along line 54, line 54 is pushed into an arc by rollers 16, as shown in FIG. 1 and the line exerts a force against inner surface 56 of cam 14, urging the rotating cam 14 to assume a locking position on the line.

For instance, if the device 10 were rapidly moving along line 54 in the direction indicated by an arrow 58 shown in FIG. 1, line 54 would be pushed into an arc, as shown, by rollers 16 and be in contact with cam 14. The natural rigidity of the line exerts a spring action against rollers 16 and cam 14, urging cam 14 to rotate in the direction shown by arrow 60.

The radius from a corner 62 of cam 14 to mounting rod 24 is longer than a radius from the central portion 64 to mounting rod 24. Accordingly, when the cam rotates in the direction indicated by arrow 60, the cross sectional area of interior 52 is reduced and the line will jam between the shell 12 and inner surface 56 of cam 14.

Of course, the same result might be had if the user of the device exerted a force on cam 14 along the direction indicated by arrow 58 causing the cam to rotate in the direction indicated by arrow 60. The spring-like action of the line provides protection beyond mere active engagement of the device. In the event of a fall, objects tend to accelerate and reach the same descent velocity therefor passive engagement of the device onto the line is desirable in order to provide a degree of fail safe protection for the user. The inventive line grip uses the resistance to bending of a line to provide passive engagement in the manner discussed above.

The symmetrical construction of the device illustrated in FIGS. 1 and 2 is such that device 10 produces equivalent results when the device is moved in either direction along a horizontal line. Moreover, if a horizontal line became unsupported on one end, as in the case where the line was supported by the support cables of a scaffold and one of the cables failed the device illustrated would provide protection regardless of which cable failed. In the event of such failure, as the horizontal safety line becomes more vertical and the user begins his descent along the line, the device would be passively engaged by its motion along the line and actively engaged by the force a user exerted on the cam.

In order that the device can be moved along line 54 it is necessary to hold the cam arm in the position shown in FIG. 1, at a right angle to line 54 and move the device along the cable against a slight force exerted by the bending of the cable into an arc between rollers 16 and cam 14. This also results from the fact that the radius from central portion 64 to mounting rod 24 is shorter than the radius from corner 62 to the mounting rod. When cam 14 is held at right angles to line 54 the cross sectional area of interior 52 is maximized and the cable will tend not to jam.

In the event that a user wearing the device actually falls and the device jams on a cable the impact of the fall will be absorbed by the massive pieces of the device comprising shell 12, rod 24 and cam 14. The inventive device thus provides a simple, durable and reliable protection method.

While an illustrative embodiment of the present has been described, it is, of course, understood that various modifications will be obvious to those of ordinary skill in the art. Such modifications are within the spirit and scope of the invention which is limited and defined only by the appended claims.

We claim:

1. A grip device attaching a man to a resilient horizontal safety line comprising:

(a) U-shaped channel means adapted to be disposed around said line and defining a channel for containing said line, said channel means having a first gripping surface on the inside of said U-shaped channel;

(b) operator means defining a second gripping surface and pivotally supported within said U-shaped channel;

(c) support means for pivotally supporting said operator means so that said second gripping surface is in a spaced facing relationship with said first gripping surface, said operator means being dimensioned so that said second gripping surface will define a plurality of radii of different length when rotated about said support means so that the distance between said first gripping surface and said second gripping surface changes from a minimum to a maximum value when said operator means is rotated about said support means; and (d) flexing means defining first and second flexing surfaces, said flexing surfaces being disposed on the side of said safety line opposite said operator means, said first flexing surface positioned adjacent one transverse side of said operator means, and said second flexing surface being positioned adjacent the other transverse side of said operator means, so that a continuous line in contact with said first and second flexing surfaces will be springedly urged into contact with said second gripping surface and said first and second flexing surfaces, said flexing means comprising a plurality of rotating elements.

2. A grip device as in claim 1, wherein said channel means comprises a U-shaped housing.

3. A grip device as in claim 2, further comprising means to attach said device to a user.

4. A grip device as in claim 1, wherein said operator means is removable.

5. A grip device as in claim 4, wherein said channel means comprises a U-shaped housing.

6. A grip device as in claim 5 further comprising means to attach said device to a user.

7. A grip device as in claim 1, wherein said flexing means are fixedly positioned with respect to said operator means.

8. A grip device as in claim 7, wherein said flexing means are substantially symmetrically positioned with respect to said operator means.

9. A grip device as in claim 1, wherein said flexing means comprises a pair of rotatably mounted member.

10. A grip device as in claim 9, wherein said operator means comprises a single rotatably mounted member.

11. A grip device attaching a man to a horizontal safety line comprising a U-shaped shell with a pair of internal rotating elements, said shell forming one side of a jamming mechanism exerting force against the line, and a wedge in the form of a cam forming another side of said jamming mechanism, said rotating elements being configured, dimensioned and positioned to cause said cam to be springedly urged against the line, said cam being further positioned, configured and dimensioned so that said cam is centrally disposed with respect to said rotating element such that said cam will jam line disposed between said shell and said cam when said cam is rotated about a pin which holds said cam and said shell to each other in a pivoted mounting relationship, said rotating elements being positioned to urge said safety line towards said cam.

12. A grip device as in claim 11, wherein said internal rotating elements are positioned, configured and dimensioned so as to alter the path of the line passing through said device from a straight line to an arc as it passes through the device as to create a spring tension against the cam of the device, so that in the event of a fall this spring tension slows the rate of fall of the device itself, thus allowing the weight of the body being protected by the device to overtake and pass the device and exert a tension on said cam which then jams the device and prevents further travel downwards.

13. A grip device as in claim 1, wherein said cam is substantially symmetrically disposed with respect to said rotating elements such as to render said grip device reversible.

* * * * *